United States Patent [19]

Trotta

[11] 4,245,389

[45] Jan. 20, 1981

[54] SAFETY RAZOR

[75] Inventor: Robert A. Trotta, Winthrop, Mass.

[73] Assignee: The Gillette Company, Boston, Mass.

[21] Appl. No.: 58,573

[22] Filed: Jul. 18, 1979

[51] Int. Cl.[3] ..... B26B 21/16

[52] U.S. Cl. ..... 30/47; 30/64

[58] Field of Search ..... 30/47, 51, 62, 63, 64

[56] References Cited

U.S. PATENT DOCUMENTS

| | | | |
|---|---|---|---|
| 1,337,435 | 4/1920 | Brown | 30/64 |
| 2,311,913 | 2/1943 | Testi | 30/62 |
| 2,591,280 | 4/1952 | Muros | 30/62 |
| 2,715,268 | 8/1955 | Randol | 30/64 |
| 2,800,713 | 7/1957 | Roth | 30/32 |
| 3,061,926 | 11/1962 | Fjeran | 30/51 |
| 3,646,674 | 3/1972 | Fitzpatrick | 30/64 |
| 3,892,036 | 7/1975 | Perry | 30/62 |
| 3,918,155 | 11/1975 | Atkins | 30/64 |
| 4,026,016 | 5/1977 | Nissen | 30/47 |

*Primary Examiner*—Gary L. Smith

*Attorney, Agent, or Firm*—Richard A. Wise; Scott R. Foster

[57] ABSTRACT

A razor including a grip portion and a head portion, the head portion including a base portion extending transversely of the grip portion and a cap portion overlying and spaced from the base portion to form a cavity therebetween adapted to receive a shaving unit, a spring member fixed to the grip portion, the spring member having a cam portion adapted to extend into the cavity, the spring member cam portion being adapted to engage an underside of the shaving unit when the shaving unit is disposed in the cavity, and a button fixed to the spring member and operative, upon having pressure applied thereto by an operator, to remove the spring member cam portion from the cavity and from engagement with the shaving unit, to free the shaving unit for removal from the cavity.

3 Claims, 11 Drawing Figures

SAFETY RAZOR

BACKGROUND OF THE INVENTION

1. Field of the Invention

This invention relates to a safety razor and is directed more particularly to a razor adapted to receive a shaving unit of the type wherein blade means is permanently fixed to additional structure, such as a platform a guard member.

2. Description of the Prior Art

U.S. Pat. No. 2,800,713—Roth, issued July 30, 1957, shows a razor having a cavity therein adapted to receive a shaving unit comprising a blade fixed to a platform and guard member. To assist in retaining the shaving unit in the razor cavity, a leaf spring is provided, the spring being attached to the exterior of the handle and extending through an opening in the shaving unit.

U.S. Pat. No. 3,388,831—Hansom, issued June 18, 1968, in FIG. 15, shows a razor having a cavity adapted to receive a shaving unit, and further shows a spring biased means in the handle for entering the cavity and engaging an underside of the shaving unit to retain the shaving unit in the cavity.

U.S. Pat. Nos. 3,644,992—Bennett et al, issued Feb. 29, 1972, and 3,646,674—Fitzpatrick, issued Mar. 7, 1972, show razors adapted to receive shaving units and having means within the shaving unit receiving cavity for engagement with the underside of the shaving unit for retention of the shaving unit in the cavity. The patents further show button means for initiating withdrawal of the shaving unit engagement means and also for ejecting the shaving unit from the razor.

U.S. Pat. Nos. 3,815,227—Hood, issued June 11, 1974, 3,816,914—Wordtmann, issued June 18, 1974; and 3,918,155—Atkins, issued Nov. 11, 1975 all show razors adapted to receive shaving units, further adapted to retain the shaving units by means of structure within the razor cavity for engaging the underside of the shaving unit, and still further, having button means for ejecting the shaving unit from the cavity when use of the shaving unit is no longer desired.

SUMMARY OF THE INVENTION

An object of the present invention is to provide a razor having a cavity for receiving a shaving unit and having spring means for engaging the underside of the shaving unit to retain the shaving unit the cavity.

A further object of the invention is to provide button means fixed to the spring member and operative to remove the spring member from engagement with the shaving unit to free the shaving unit for removal from the razor cavity without ejecting the shaving unit therefrom.

A still further object of the invention is to provide a relatively simple and inexpensive means for releasably holding a shaving unit in a razor of the type described above.

A still further object of the invention, in an alternative embodiment thereof, is to provide such a razor, including the shaving unit retention and release means, comprising a single unitary molded member.

With the above and other objects in view, as will hereinafter appear, a feature of the present invention is the provision of a razor comprising a grip portion and a head portion, the head portion including a base portion extending transversely of the grip portion at one end of the grip portion and a cap portion overlying and spaced from the base portion to form a cavity therebetween adapted to receive a shaving unit, a spring member fixed to the grip portion, the spring member having a cam portion adapted to extend into the cavity, the spring member cam portion being adapted to engage an underside of the shaving unit when the shaving unit is disposed in the cavity, and button means fixed to the spring member and operative upon having pressure applied thereto by an operator, to remove the spring member cam portion from the cavity and from engagement with the underside of the shaving unit, whereby to free the shaving unit for removal from the cavity.

In accordance with a further feature of the invention the grip portion, head portion, button means, and spring member comprise molded integral parts of the razor.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

DESCRIPTION OF THE DRAWINGS

Reference is made to the accompanying drawings in which is shown an illustrative embodiment of the invention from which its novel features and advantages will be apparent.

DESCRIPTION OF THE PREFERRED EMBODIMENT

Figure 1:
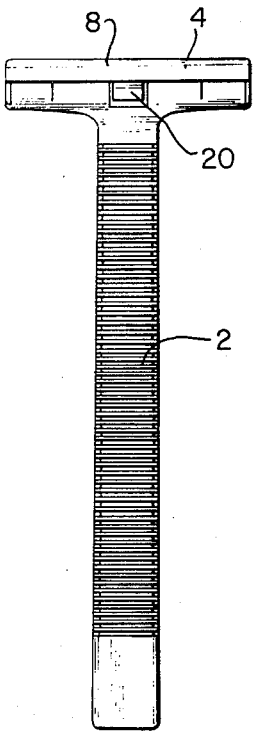
FIG. 1 is a front elevational view of one form of safety razor illustrative of an embodiment of the invention.
Figure 3:
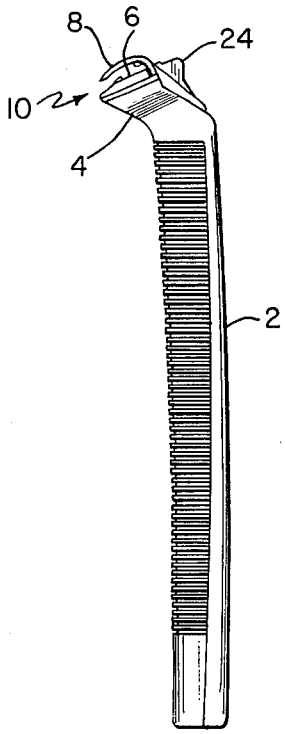
FIG. 3 is a side elevational view thereof.
Figure 2:
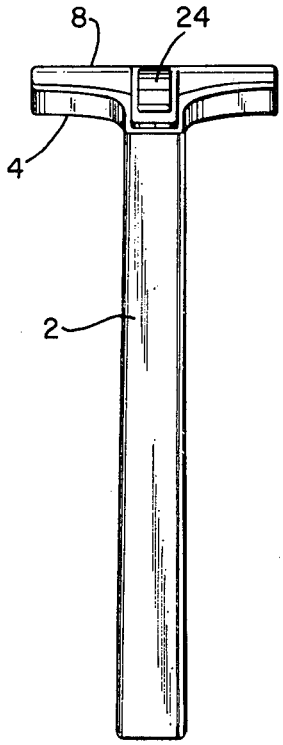
FIG. 2 is a back elevational view thereof.

Referring to the drawings, it will be seen that the illustrative razor includes a grip portion 2 and a head portion 4. The head portion 4 includes a base portion 6 extending transversely of the grip portion at one end of the grip portion. The head portion 4 further includes a cap portion 8 overlying and spaced from the base portion 6 to form a cavity 10 therebetween.

Figure 4:
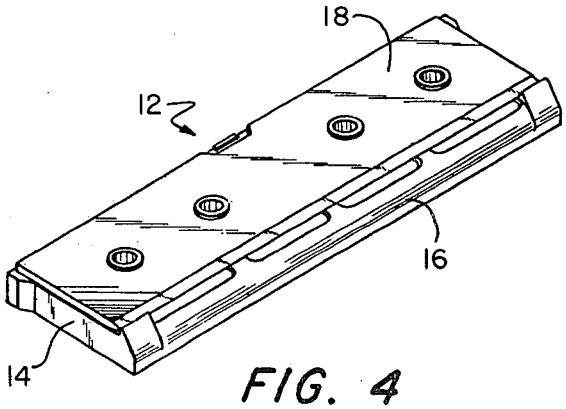
FIG. 4 is a perspective view of a representative shaving unit suitable for use with the razor shown in FIGS. 1–3.
Figure 5:
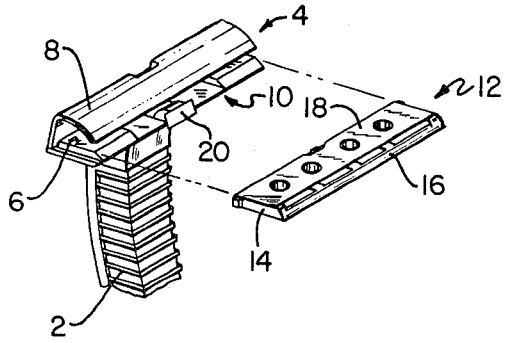
FIG. 5 is a perspective view illustrative of the manner in which the shaving unit of FIG. 4 is introduced into the razor of FIGS. 1–3.
Figure 6:
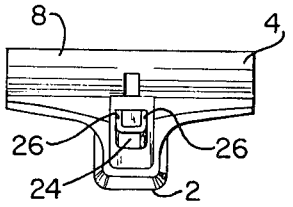
FIG. 6 is a top plan view of the razor of FIGS. 1–3.
Figure 7:
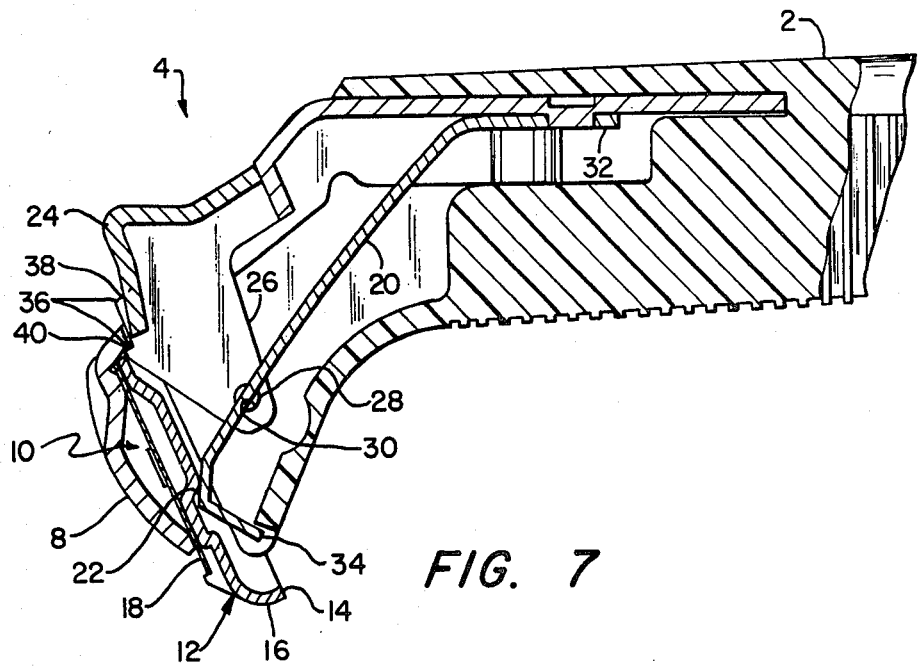
FIG. 7 is a centerline sectional view of the razor, shown with a shaving unit in position for a shaving operation.

The cavity 10 is adapted to receive a shaving unit 12, shown in FIGS. 4, 5 and 7. The shaving unit 12 includes a platform member 14 having a guard portion 16. A blade means 18 is permanently fixed to the platform member 14.

Figure 8:
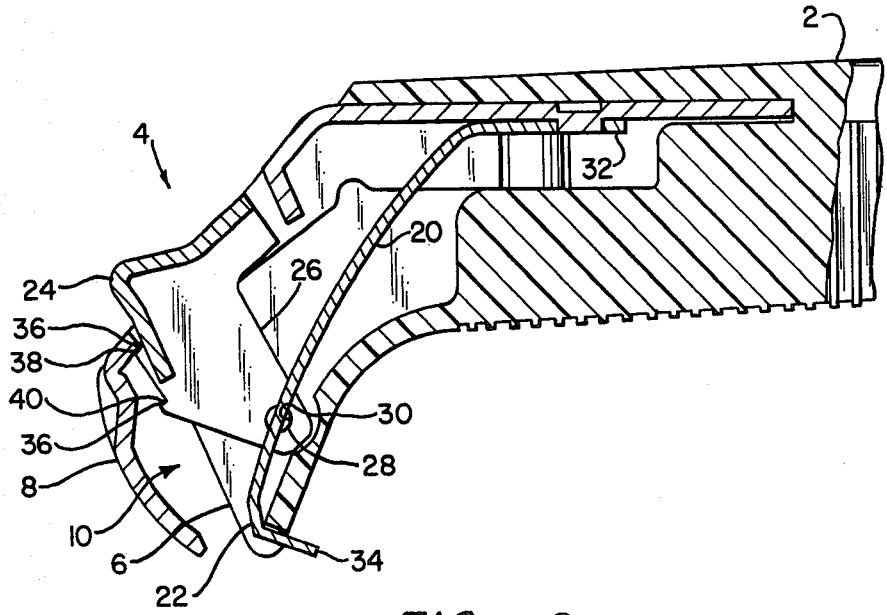
FIG. 8 is a centerline view, similar to FIG. 7, but showing the razor without the shaving unit therein.

Referring to FIGS. 7 and 8, it will be seen that the razor includes a spring member 20 fixed to the grip portion of the razor, the spring member 20 having a cam portion 22 adapted to extend into the cavity 10. The spring member cam portion 22 is adapted to engage an underside of the shaving unit 12, as seen in FIG. 7, when the shaving unit is disposed in the cavity. In the position shown in FIG. 7, the spring member 20 biases the shaving unit 12 against the cap portion 8 to retain the shaving unit in the cavity 10. The spring member 20 also exercises a bias on the shaving unit 12 in a direction toward the back of the cap portion to keep the shaving unit well seated within the cavity.

A button means 24 is fixed to the spring member 20, as best seen in FIGS. 7 and 8. The button means 24 is provided with a pair of wing portions 26 which are pivotally connected to the spring member 20. In the embodiment shown in FIGS. 7 and 8, the spring member 20 comprises a leaf spring member having ears 28 extending therefrom on either side thereof, the ears 28 being disposed in apertures 30 in the wing portions 26. The spring member 20 is preferably anchored at a first end 32 to the razor, the cam portion 22 of the spring 20 being disposed proximate a second, or free end 34, of the spring. The button means 24 is preferably pivotally connected to the spring member 20 at a point proximate the cam portion 22 of the spring member.

The wing portions 26 of the button means 24 may be provided with stop means 36 which are engageable with a rearward portion of the cap portion 8 to retain the button means 24 in a selected position. For example, in FIG. 7 there is shown the razor with the shaving unit in place for a shaving operation, the spring member 20 bearing against the shaving unit 12 to securely retain the shaving unit in the razor cavity 10. The button means 24 is disposed in a first position in which a stop means first surface 40 is in engagement with the cap portion 8 and the wing portions 26 operate to bear against the underside of the shaving unit 12 in the vicinity of its rearward edge. Thus, the wing portions 26, as well as the cam portion 22 of the spring member 20, operate to retain the shaving unit in its proper position.

In FIG. 8, there is shown the razor without the shaving unit and it may be seen that the button means 24 has been pushed forward to remove the spring means 20 from the cavity 10. Further, a stop means second surface 38 has engaged the cap portion 8 so as to retain the spring means 20 in the "open" position, enabling the cavity 10 to receive another shaving unit.

In the above described embodiment, the spring means comprises a leaf spring, preferably of metal, which is attached to the handle, as shown in FIGS. 7 and 8, and which is pivotally attached to the button means 24, as described above. In the embodiment shown in FIGS. 9, 10 and 11, the entire razor assembly is a one-piece molded item. The grip portion 2, the head portion 4, and the button means 24, as well as the spring means 20 and cam potion 22 are all molded as one unit.

In operation, the razor, as shown in FIG. 8, is adapted to receive the shaving unit shown in FIG. 4. As shown in FIG. 5, the blade unit is slid edgewise into the cavity 10 of the razor head portion 4. Upon entering the cavity 10 the rearward edge of the shaving unit engages the wing portions 26 of the button means 24 causing the button means to be depressed slightly about its pivot axis so as to free the stop means second surface 38 from the rearward lip of the cap portion 8 to permit the button means 24 to retract to the position shown in FIG. 7 in which the stop means first surface 40 engages the rearward lip of the cap portion 8 and the wing portions 26 of the button means 24, as well as the cam portion 22 of the spring member 20 exercise a holding force on the blade unit, urging the blade unit against the interior of the cap portion 8 and backwardly against the rearward lip of the cap portion. To release the shaving unit from the cavity, the button means 24 is depressed by an operator to move the wing portions forward and remove the wing portions 26 and the cam surface 22 of the spring member 20 from contact with the blade unit. As shown in FIG. 8, the button member is moved to the point at which the stop means second surface 38 engages the rearward lip of the cap portion 8 and the spring member 20 is removed from the cavity 10. Thus, the blade unit 12 is freed from its retaining influences, and an operator may easily remove the shaving unit 12 from the cavity 10. The shaving unit 12 is easily and readily removable from the cavity 10, but is not ejected therefrom, thereby avoiding the dangers associated with ejection of a sharp cutting edge from the razor.

Figure 9:
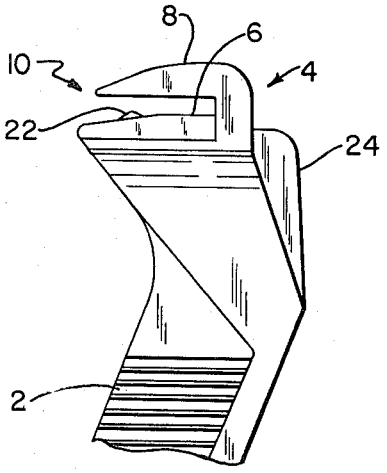
FIG. 9 is a side elevational view of an alternative form of razor illustrative of another embodiment of the invention.
Figure 11:
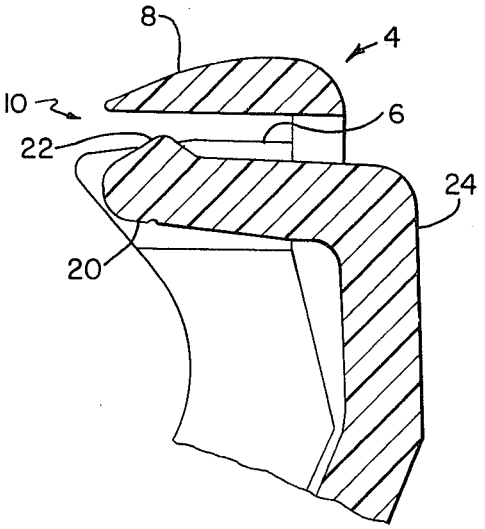
FIG. 11 is a centerline sectional view of the razor shown in FIG. 9.
Figure 10:
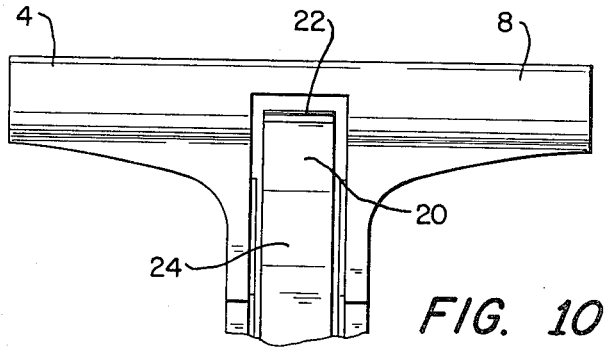
FIG. 10 is a back elevational view of the razor shown in FIG. 9.

In the alternative embodiment shown in FIGS. 9–11, the button means 24' is pushed forwardly, or leftwardly, as shown in FIG. 11, to remove the cam portion 22' from the cavity 10'. A shaving unit 12 is then inserted into the cavity 10' until the rearward edge of the shaving unit abuts the rearward wall of the cavity. When the shaving unit is in place in the cavity, the button means 24' is released and the elastomeric properties of the molded plastic cause the spring member 20' to return to the position shown in FIG. 11 so that the cam portion 22' may engage the underside of the shaving unit 12. To release the blade unit, the button means 24' is again depressed, removing the cam portion 22' from the cavity area 10', to permit withdrawal of the shaving unit from the cavity.

It is to be understood that the present invention is by no means limited to the particular construction herein disclosed and/or shown in the drawings, but also comprises any modifications or equivalents within the scope of the disclosure.

Having thus described my invention what I claim as new and desire to secure by Letters Patent of the United States is:

1. A razor comprising a grip portion and a head portion, said head portion including a base portion extending transversely of said grip portion at one end of said grip portion and a cap portion overlying and spaced from said base portion to form a cavity therebetween adapted to receive a shaving unit, a leaf spring member fixed to said razor, sid spring member having a cam portion adapted to extend into said cavity, said spring member cam portion being adapted to engage an underside of said shaving unit when said shaving unit is disposed in said cavity, said spring member being provided with a pair of ears, and button means having opposed wing portions having apertures, said ears being received in said apertures to pivotally connect said button to said spring member, said button being operative, upon having pressure applied thereto by an operator, to remove said spring member cam portion from said cavity and from engagement with said underside of said shaving unit, whereby to free said shaving unit for removal from said cavity.

2. The invention in accordance with claim 1 in which said wing portions are provided with first and second stop means for determining first and second positions of said cam portion.

3. The invention in accordance with claim 1 in which said wing portions are adapted to abut said shaving unit when said shaving unit is disposed in said cavity.

* * * * *